US009181762B2

(12) United States Patent
Stoldt et al.

(10) Patent No.: US 9,181,762 B2
(45) Date of Patent: Nov. 10, 2015

(54) DEVICE FOR SECURING PIPES HAVING VARIOUS DIAMETERS

(75) Inventors: Frederik Stoldt, Hamburg (DE); Jens Baier, Hamburg (DE)

(73) Assignee: BLOHM + VOSS OIL TOOLS GMBH, Hamburg (DE)

( * ) Notice: Subject to any disclaimer, the term of this patent is extended or adjusted under 35 U.S.C. 154(b) by 340 days.

(21) Appl. No.: 13/511,449

(22) PCT Filed: Nov. 23, 2010

(86) PCT No.: PCT/DE2010/001382

§ 371 (c)(1),
(2), (4) Date: Jul. 5, 2012

(87) PCT Pub. No.: WO2011/060773

PCT Pub. Date: May 26, 2011

(65) Prior Publication Data

US 2012/0261528 A1 Oct. 18, 2012

(30) Foreign Application Priority Data

Nov. 23, 2009 (DE) ..... 10 2009 056 393

(51) Int. Cl.
*E21B 19/07* (2006.01)
*E21B 19/086* (2006.01)
*E21B 19/06* (2006.01)

(52) U.S. Cl.
CPC ..... *E21B 19/06* (2013.01)

(58) Field of Classification Search
CPC ..... E21B 19/086; E21B 19/06; E21B 19/07; E21B 19/10
USPC ..... 166/85.5, 77.52
See application file for complete search history.

(56) References Cited

U.S. PATENT DOCUMENTS

| | | | | | |
|---|---|---|---|---|---|
| 1,664,461 | A * | 4/1928 | Montgomery | 294/102.2 |
| 2,048,209 | A * | 7/1936 | Young | 188/67 |
| 2,063,378 | A * | 12/1936 | Hiniker | 188/67 |
| 2,641,816 | A * | 6/1953 | Liljestrand | 188/67 |
| 3,358,341 | A * | 12/1967 | Burstall | 294/102.2 |
| 4,275,488 | A * | 6/1981 | Gray et al. | 294/102.2 |
| 4,511,168 | A * | 4/1985 | Haynes | 294/102.2 |
| 4,647,099 | A | 3/1987 | Berry et al. | |
| 8,079,627 | B2 * | 12/2011 | Lutzhoft et al. | 294/90 |
| 2009/0252589 | A1 * | 10/2009 | Sonneveld et al. | 414/800 |

FOREIGN PATENT DOCUMENTS

| | | |
|---|---|---|
| EP | 0589823 Y | 3/1994 |
| EP | 1726774 Y | 11/2006 |

* cited by examiner

*Primary Examiner* — Kenneth L Thompson
(74) *Attorney, Agent, or Firm* — Lucas & Mercanti, LLP; Klaus P. Stoffel

(57) ABSTRACT

A device for vertically holding pipes for elevator systems on oil drilling platforms has a basic element with a pivotable door element. A closing movement for forming a cylinder liner is carried out by a lockable adjusting cylinder. The cylinder liner is formed by interchangeable cylinder segments to form a cylinder liner of different size diameters in the basic element and door element. The cylinder segments are arranged interchangeably via rear guide profiles and associated profile rails in the basic element and door element. Upper sides of the cylinder segments are connected to corresponding receptacles via retaining rings which are able to be pushed on horizontally. By receiving pipes in the cylinder liner and an occurring load, a spring-loaded actuating arm is adjustable in height via a cylinder segment. Locking of the hydraulic adjusting cylinder for the closing movement is controllable via an associated load sensor.

5 Claims, 6 Drawing Sheets

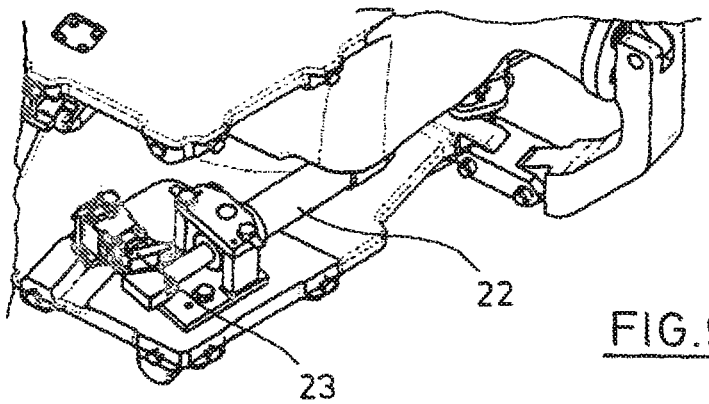
FIG.9
FIG.10
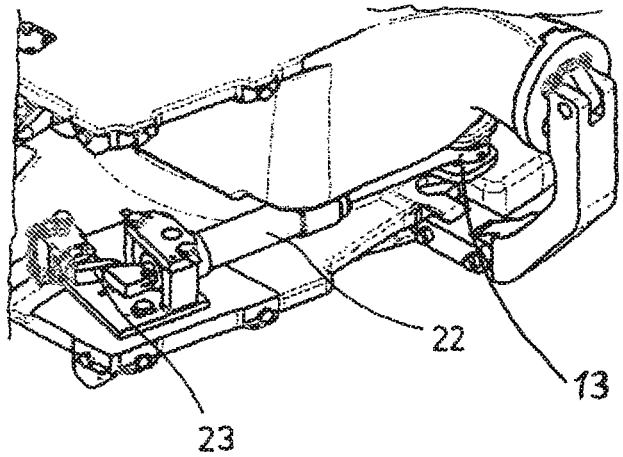

DEVICE FOR SECURING PIPES HAVING VARIOUS DIAMETERS

The present application is a 371 of international application PCT/DE2010/001382, filed Nov. 23, 2010, which claims priority of DE 10 2009 056 393.8, filed Nov. 23, 2009, the priority of these applications is hereby claimed and these applications are incorporated herein by reference.

BACKGROUND OF THE INVENTION

The invention relates to a device for vertically holding pipes of differing diameter for elevator systems for picking up, lifting and depositing a line of pipes or individual pipe segments onto oil platforms, consisting of a basic element for forming a cylinder liner with a swivel joint for an associated door element to complete the liner, wherein the swivel joint has a closure which is spaced apart and has a pivotable catch with a closure pin, and the closing movement is controllable via an associated hydraulic adjusting cylinder.

Diverse embodiments of this type are known, wherein the opening and closing take place by adjusting cylinders via a hydraulic controlling means. There is the drawback in this case that the arrangements are configured only for one pipe size and the retrofitting of the cylinder liner can be carried out in situ only with a large outlay. The standpoint that an opening movement of the door element will not be able to be carried out under load in the event of different pipe sizes is of great importance in practice.

SUMMARY OF THE INVENTION

It is the object of the invention to provide a simple retrofittable arrangement for different pipe diameters, which arrangement permits adaptation in situ and ensures that the liner is secured for holding under load.

This object is achieved according to the invention in that cylinder segments for forming the cylinder liner in different size diameters are arranged interchangeably in the basic element and door element via rear guide profiles and associated profile rails in the basic element and door element, and the upper sides of the individual cylinder segments are connected to corresponding receptacles via retaining rings which are assigned so as to be able to be pushed on horizontally, wherein, by reception of pipes in the cylinder liner and of an occurring load, a spring-loaded actuating arm is adjustable in the height thereof via a cylinder segment, and locking of the hydraulic adjusting cylinder for the closing movement is controllable via an associated load sensor.

By this means, given the present conditions with relatively large diameters, retrofittings can be carried out by the individual cylinder segments in accordance with the pipe size used, and load-dependent locking is possible.

For good fixing of the cylinder segments, it is provided that the cylinder segments have additional retaining elements in the lower part for corresponding reception in the basic element and door element.

An advantageous embodiment consists in that three cylinder segments are arranged in the basic element and two cylinder segments of the cylinder liner are arranged in the door element.

For the automatic closure of the door element after insertion of pipes, it is provided that a cylinder segment in the basic element has a protruding trigger pin which, after reception of pipes, controls the adjusting cylinder for the closing movement.

In a further refinement and in order to protect an inserted trigger pin, it is provided that the trigger pin is connected via a spring to a hollow piston cylinder which, after activation of the adjusting cylinder, holds the trigger pin in a drawn-back position.

BRIEF DESCRIPTION OF THE DRAWING

FIG. 2 shows a view of an open cylinder liner with the cylinder segments thereof and with a connection of the cylinder segments in the upper region via retaining rings which are pushed on;

FIGS. 9 and 10 show a valve activation of an adjusting cylinder for closing purposes in an open and closed position;

FIG. 13 shows a section through a cylinder segment with a trigger pin, and

FIG. 14 shows an overall illustration of the device in the closed position of the cylinder liner.

DETAILED DESCRIPTION OF THE INVENTION

Figure 1:
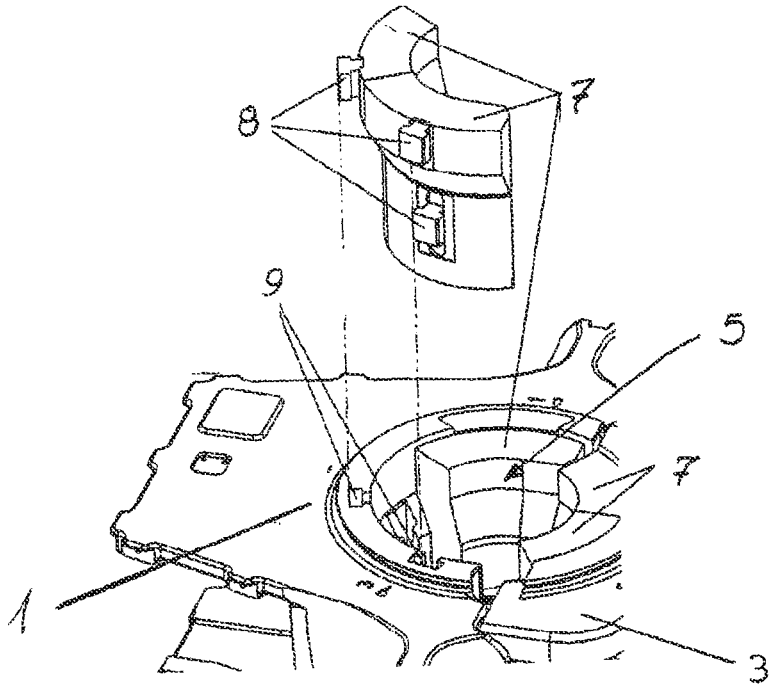
FIG. 1 shows a top view of a cylinder liner formed in the basic element and door element with a cylinder segment pulled out.
Figure 2:
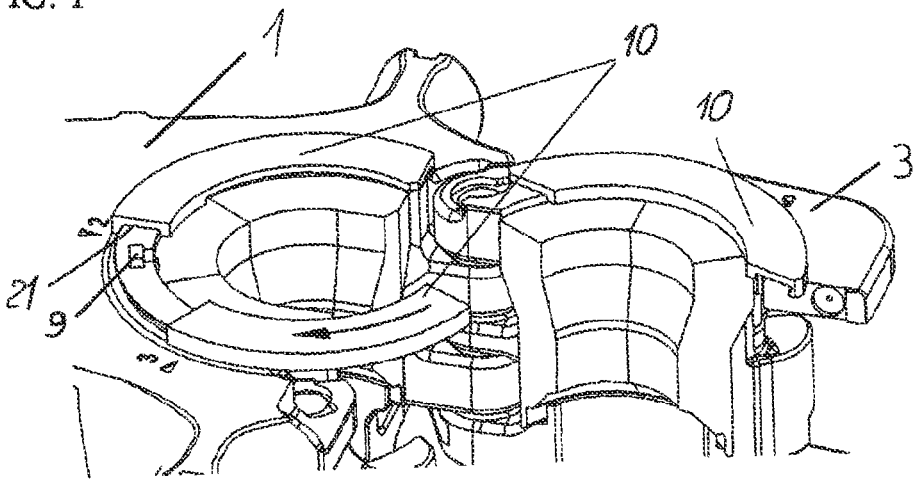
Figure 3:
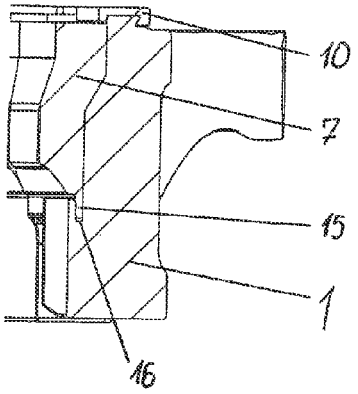
FIG. 3 shows a partial section through a basic element with an inserted cylinder segment.
Figure 4:
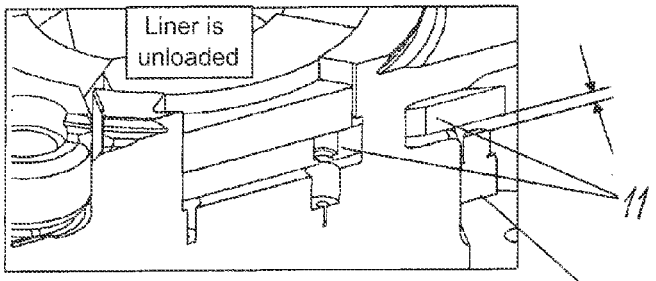
FIG. 4 shows an unloaded cylinder liner with an assigned load sensor.
Figure 5:
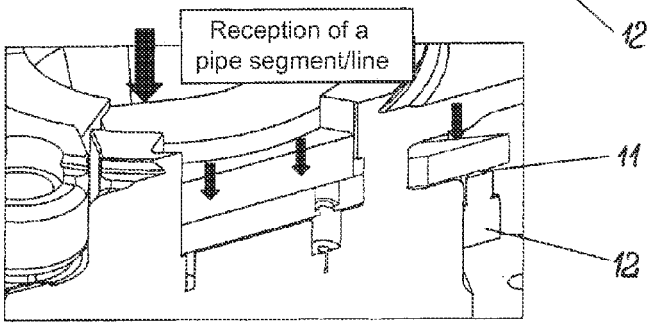
FIG. 5 shows an illustration as per FIG. 4 with a loaded cylinder liner and activated load sensor.
Figure 6:
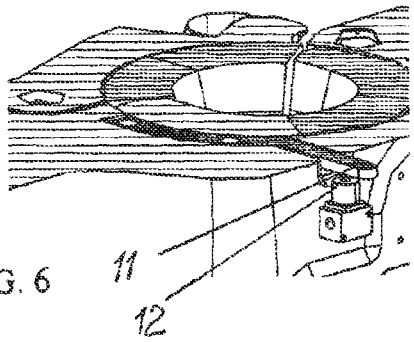
FIGS. 6 and 7 show a cylinder liner in the unloaded and loaded state with a spring-loaded actuating arm for a load sensor.
Figure 7:
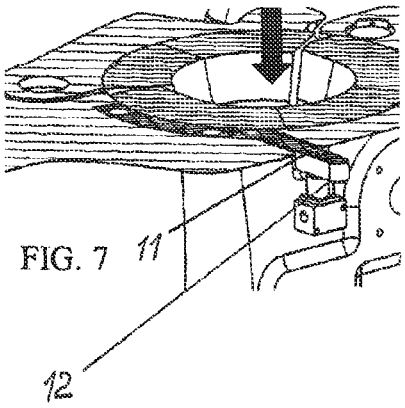
Figure 8:
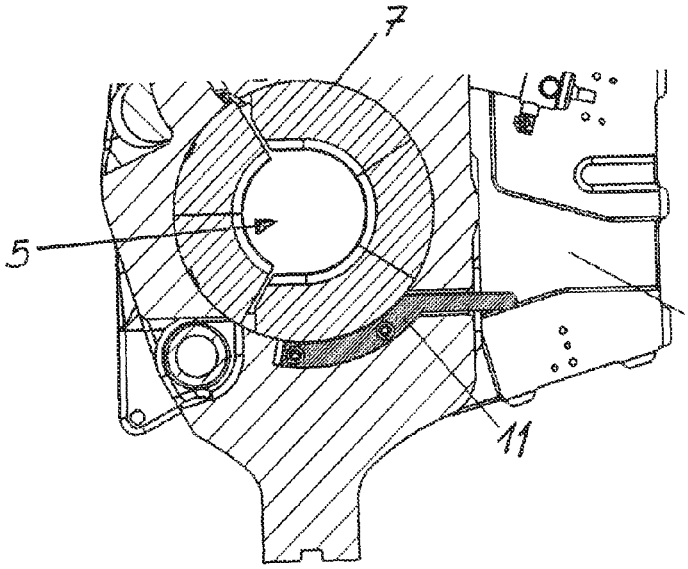
FIG. 8 shows a top view of FIGS. 6 and 7.
Figure 11:
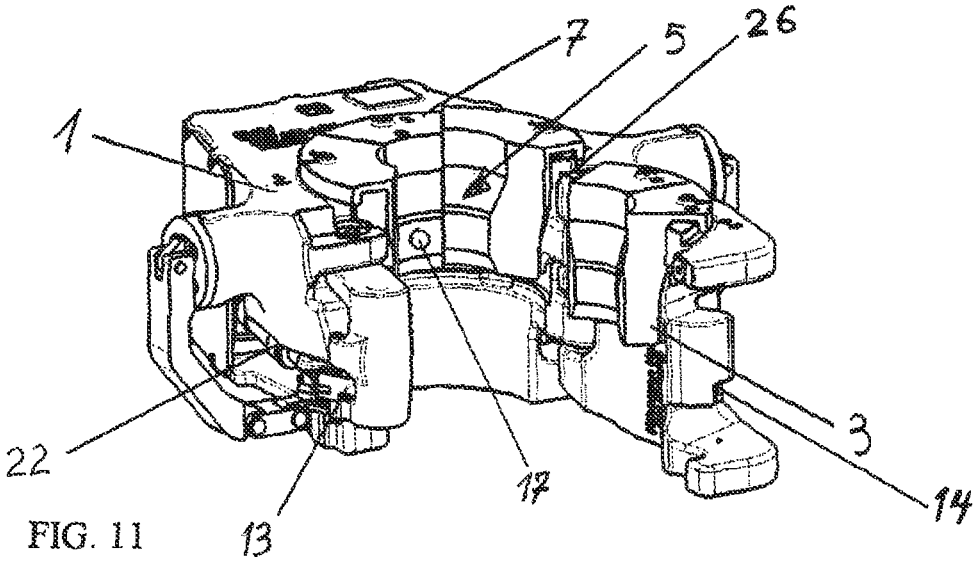
FIGS. 11 and 12 show an assignment of a trigger pin in the basic element for the valve activation for a closing movement and as an external view with the valve in a closed arrangement.
Figure 12:
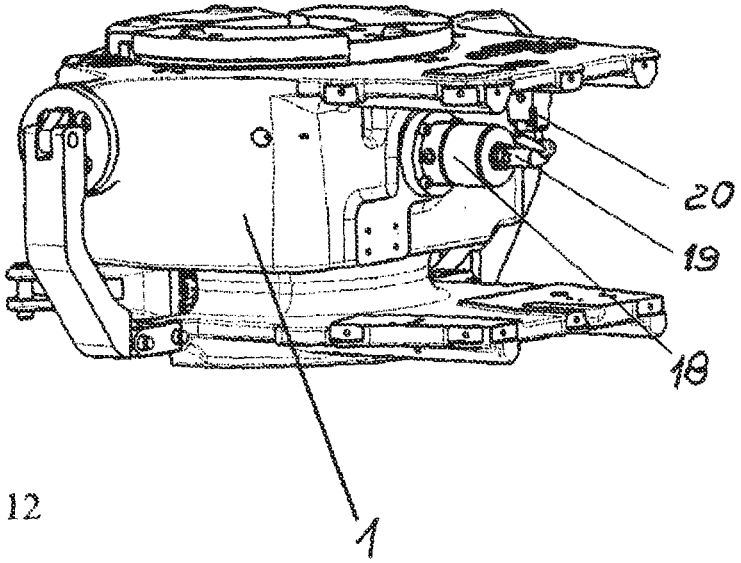
Figure 1:
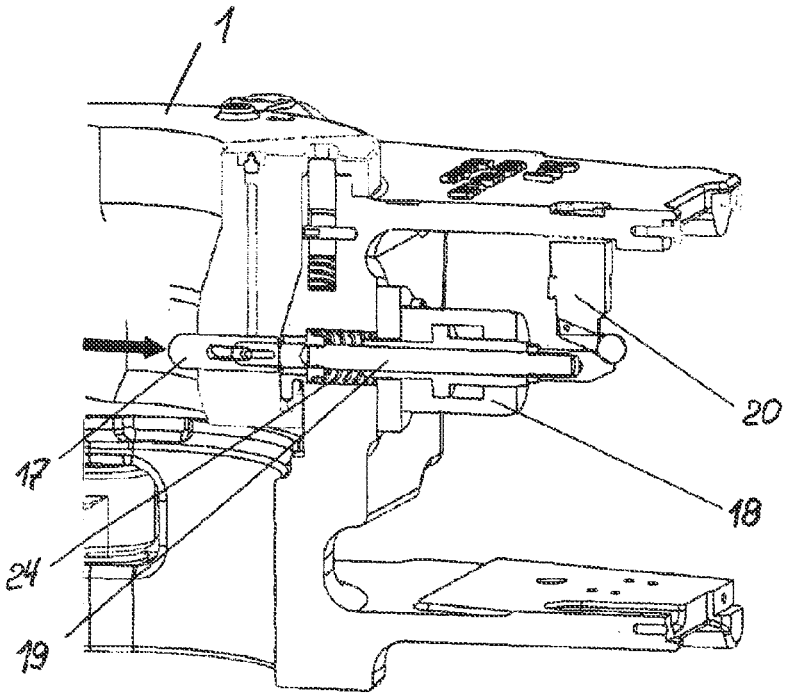
Figure 1:
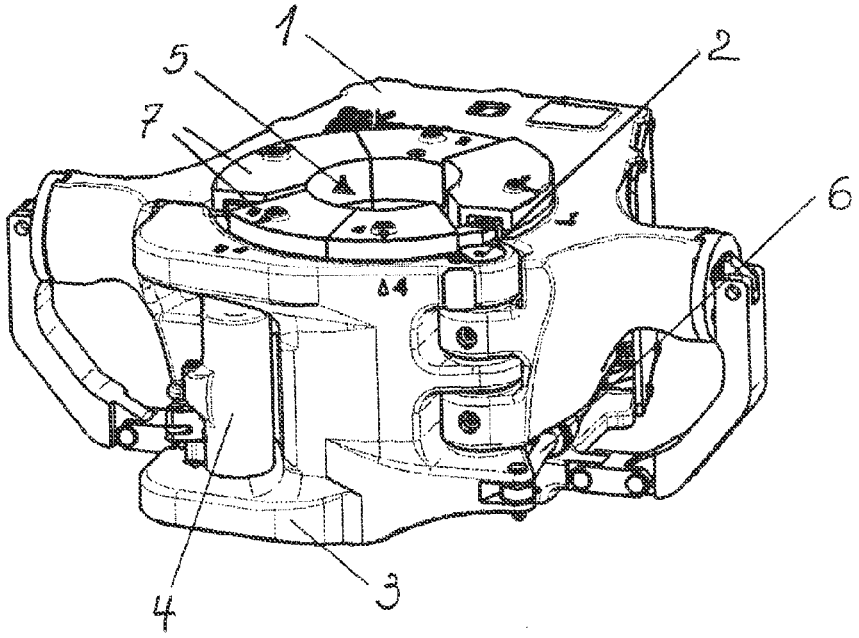

The device essentially consists of a basic element 1 with a door element 3 which is pivotable via a hinge pin 2 and, in the closed state via a closure element 4 on the basic element 1, is controllable via an adjusting cylinder 6 in order to form a cylinder liner 5 with a swivel joint 26 for the door element 3 to complete the liner 5.

The cylinder liner 5 is formed by individual cylinder segments 7 which are fixed interchangeably on the basic element 1 and door element 3. For this purpose, the cylinder segments 7 are connected to rear guide profiles 8 which can be pushed into associated profile rails 9 and secured.

In the upper region, the cylinder segments 7 are connected to a corresponding receptacle 21 for the cylinder segments 7 via retaining ring segments 10 which can be pushed on horizontally.

In this embodiment, a cylinder segment 7 is connected to a spring-loaded actuating arm 11 and, when a pipe is inserted and therefore a load occurs, acts on a load sensor 12 which, upon closure of the device, blocks the adjusting cylinder 6. The load sensor 12 is an internal interlock in the hydraulic controlling means of the adjusting cylinder 6, connecting an opening of the cylinder liner 5 and release of a load. An operator therefore receives a signal as soon as the load sensor 12 has been actuated and therefore the elevator is under load.

The hydraulic adjusting cylinder 6 permits opening and closing of the door element 3. The door element 3 can be opened by 90° in order to be able to receive pipes. In the closed position, the door element 3 rests on the basic element 1. As soon as the door element 3 is closed, a hydraulic closure cylinder 22 is automatically actuated by a hydraulic controlling means with a valve 23. The closure cylinder 22 is connected to a closure 13 with a locking pin 14 and therefore enables closing. The door element 3 is kept in the closed position by said closure 13 with the locking pin 14 and is connected to the basic element 1. An additional locking prevents inadvertent opening of the closure should the hydraulics fail or a line break.

In this embodiment, three cylinder segments 7 are arranged in the basic element 1 and two cylinder segments 7 are arranged on the door element 3. In this case, the cylinder segments 7 are connected on the lower side in a form-fitting manner via additional retaining elements 15 and corresponding receptacles 16 for additional guidance and securing. The formation of individual cylinder segments 7 in order to form the cylinder liner 5 makes it possible to reduce the weight, and the times for a change to a different pipe diameter are reduced.

To automatically close the door element 3 after reception of a pipe in the open cylinder liner 5, a trigger pin 17 is arranged in the central cylinder segment 7 of the basic element 1. A hydraulic hollow piston cylinder 18 which is connected to the trigger pin 17 by a basic body is located level with the trigger pin 17. Upon reception of a pipe, the pipe strikes against the trigger pin 17. The trigger pin 17 impacts against a cylinder rod 19 of the hollow piston cylinder 18, presses said cylinder rod through the hollow piston cylinder 18 counter to a spring 24 and actuates a trigger valve 20 which activates the hollow piston cylinder 18. The hollow piston cylinder 18 moves the cylinder rod 19 and therefore moves the trigger pin 17 away from the inserted pipe. The movement back of the hollow piston cylinder 18 avoids wear to the trigger pin 17 which would otherwise bear continuously against the pipe. In addition, upon actuation of the trigger valve 20 by the hydraulic controlling means, the door element 3 is automatically closed and locked.

The invention claimed is:

1. A device for vertically holding pipes of differing diameter for elevator systems for picking up, lifting and depositing a line of pipes or individual pipe segments onto oil platforms, the device comprising: a basic element for forming a cylinder liner having a swivel joint for an associated door element to complete the cylinder liner, wherein the swivel joint has a closure on the basic element and has a locking pin on the door element; a hydraulic closing cylinder connected to the closure for controlling closing movement of the closure, wherein cylinder segments for forming the cylinder liner in different size diameters are arranged interchangeably in the basic element and the door element by rear guide profiles and associated profile rails in the basic element and the door element; wherein upper sides of the individual cylinder segments are connected to corresponding receptacles by retaining ring segments that are arranged so as to be able to be pushed on horizontally; a spring-loaded actuating arm that is height adjustable, wherein, during reception of pipes in the cylinder liner and an occurring load, the spring-loaded actuating arm is adjustable in the height thereof via one of the cylinder segments; and a load sensor for controlling locking of a hydraulic adjusting cylinder arranged for closing movement of the door element.

2. The device as claimed in claim 1, wherein the cylinder segments have additional retaining elements in a lower part for corresponding reception in the basic element and the door element.

3. The device as claimed in claim 1, wherein three cylinder segments are arranged in the basic element and two cylinder segments of the cylinder liner are arranged in the door element.

4. The device as claimed in claim 1, wherein a cylinder segment in the basic element has a protruding trigger pin which, after reception of pipes, controls the hydraulic adjusting cylinder for the closing movement.

5. The device as claimed in claim 4, wherein the protruding trigger pin is connected via a spring to a hollow piston cylinder which, after activation of the hydraulic adjusting cylinder, holds the trigger pin in a drawn-back position.

* * * * *